United States Patent [19]

Iyama et al.

[11] 4,119,887

[45] Oct. 10, 1978

[54] STARTER FOR DISCHARGE LAMP

[75] Inventors: Hiroyuki Iyama; Mitsuo Akatsuka, both of Tokyo; Teruichi Tomura, Kunitachi, all of Japan

[73] Assignee: Hitachi, Ltd., Japan

[21] Appl. No.: 672,145

[22] Filed: Mar. 31, 1976

[30] Foreign Application Priority Data

Jun. 27, 1975 [JP] Japan ..... 50-79394
Oct. 6, 1975 [JP] Japan ..... 50-119742

[51] Int. Cl.[2] ..... H05B 41/18
[52] U.S. Cl. ..... 315/101; 315/99; 315/106; 315/DIG. 5
[58] Field of Search ..... 315/94, 99, 101, 105, 315/106, 260, DIG. 2, DIG. 5

[56] References Cited

U.S. PATENT DOCUMENTS

| | | | |
|---|---|---|---|
| 3,588,592 | 6/1971 | Brandstadter | 315/99 |
| 3,924,155 | 12/1975 | Vogeli | 315/DIG. 5 |
| 3,978,369 | 8/1976 | Imaizumi et al. | 315/101 X |
| 4,015,167 | 3/1977 | Samuels | 315/105 X |

*Primary Examiner*—Eugene R. LaRoche
*Attorney, Agent, or Firm*—Craig & Antonelli

[57] ABSTRACT

A starter for a discharge lamp including first and second filaments, comprises an SCR having an anode and a cathode connected in series through the first and second filaments and a ballast transformer to an AC power supply. The gate electrode and the anode of the SCR are connected to each other through a first resistor, while the gate electrode is further connected through a second resistor to the power supply side.

9 Claims, 10 Drawing Figures

STARTER FOR DISCHARGE LAMP

BACKGROUND OF THE INVENTION

1. FIELD OF THE INVENTION

This invention relates to a starter for discharge lamp, or more in particular to a starter for discharge lamp using a semiconductor switch element.

2. DESCRIPTION OF THE PRIOR ART

A widely used conventional starter for a discharge lamp having preheating electrodes or filaments employs a glow starter as shown in FIG. 1. In this drawing, reference numeral 1 shows an AC power supply, numeral 2 a ballast, numeral 3 a discharge lamp having filaments $f_1$ and $f_2$, numeral 4 a noise-blocking capacitor and reference character G a glow starter. When impressed with a voltage from the AC power supply 1, the glow starter G discharges thereby to temporarily close its contacts. During the temporary closure of the contacts, the filaments $f_1$ and $f_2$ are preheated. When the contacts of the glow starter G open again later, the ballast 2 produces a surge voltage whereby the discharge lamp 3 begins to glow. Upon completion of this discharge, the tube voltage drops, thereby preventing the glow starter G from discharging, so that the contacts of the glow starter G are kept open. Character S in the diagram shows a start switch.

The above-mentioned conventional glow-switch device has the disadvantages of a long starting time required and a short service life. Also, the glow starter often fails. Further, the glow switch is apt to promote the deterioration of the discharge lamp.

SUMMARY OF THE INVENTION

Accordingly, it is an object of the present invention to provide a starter for a discharge lamp capable of firing the discharge lamp in a short starting time, namely, capable of instantaneous lighting of the discharge lamp.

Another object of the invention is to provide a starter for a discharge lamp which does not use a glow-switch and hence is free from faults derived from the use of glow-switch.

Still another object of the invention is to provide a starter for a discharge lamp which consumes a comparatively small amount of power.

A further object of the invention is to provide a starter for a discharge lamp capable of reliably switching the discharge lamp on and off.

In order to achieve the above-mentioned objects, the starter according to the invention employs a three-terminal semiconductor switch such as an SCR as a semiconductor switching element.

In another aspect of the present invention, the gate of the switching element is connected with a first diode. Also, the cathode of the switching element is connected with a second diode.

DESCRIPTION OF THE PREFERRED EMBODIMENTS

Figure 2:
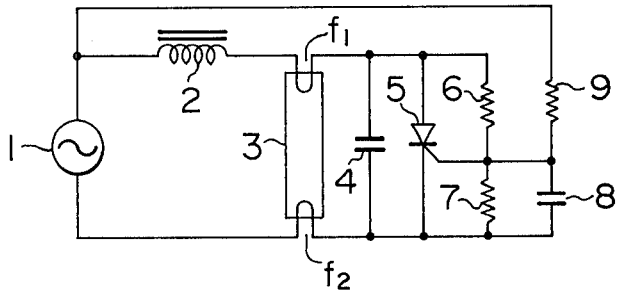
FIG. 2 is a diagram showing the configuration of an embodiment of the present invention.

In FIG. 2 showing a starter for a discharge lamp according to the invention, a three-terminal semiconductor switching element such as a silicon-controlled rectifier SCR is used as switching element in place of the conventional glow switch.

Figure 1:
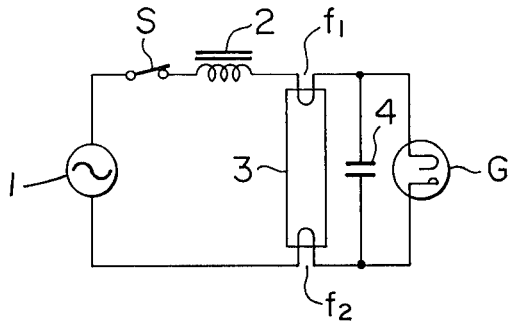
FIG. 1 PRIOR ART
FIG. 1 diagrammatically shows a conventional starter using a glow-switch.

Like or equivalent component elements are denoted in FIG. 2 by like reference numerals and characters in FIG. 1. Numeral 5 shows an SCR, numerals 6 and 7 resistors, numeral 8 a capacitor and numeral 9 another resistor.

Figure 3:
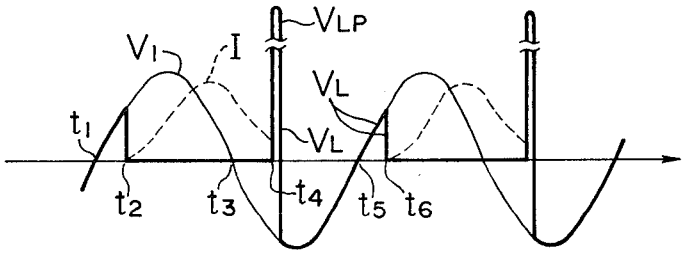
FIG. 3 is a diagram for explaining the operation of the embodiment illustrated in FIG. 2.

To facilitate an understanding of the operation of the starter, waveforms of voltage and current at various parts of the circuit of FIG. 2 are shown in FIG. 3. Symbol $V_1$ shows the waveform of the source voltage, and symbol I is the current flowing through the ballast 2, the preheating electrodes of the discharge lamp 3 and anode of the silicon controller rectifier 5. Symbol $V_L$ shows the waveform of the voltage across the discharge lamp, namely, the anode voltage of the silicon controlled rectifier 5. In operation, first assume that while the silicon controlled rectifier 5 is non-conductive, the voltage $V_1$ of the power supply 1 increases forwardly. The voltage across the lamp 3, namely, the anode voltage $V_L$ of the silicon controlled rectifier 5 increases. The gate voltage increases through the gate trigger circuit including the resistors 6 and 7 and the capacitor 8. Then, the gate current begins to flow. At time $t_2$ in FIG. 3 when the source voltage reaches a predetermined level, the gate voltage turns on the silicon-controlled rectifier 5. A forward current I flows through the power supply 1, the ballast 2, the preheating electrodes $f_1$ and $f_2$ of the discharge lamp 3 and the silicon-controlled rectifier 5, so that the preheating electrodes $f_1$ and $f_2$ are heated between time points $t_2$ and $t_3$. Since the ballast 2 is an inductive element, the current I continues to flow during the period of time from $t_3$ and $t_4$ when the source voltage $V_1$ makes up a reverse voltage of the silicon-controlled rectifier 5. During this period, the gate is supplied from the power supply 1 through the cathode of the silicon-controlled rectifier 5 and the resistor 9 with a reverse current to turn off the silicon-controlled rectifier 5. The resistor 9 is selected at such a value as to limit the gate reverse current to a proper value, the silicon-controlled rectifier 5 is turned off at time $t_4$ when the anode current I is reduced to a predetermined magnitude of, say, a hundred to several hundred milliamperes.

As a result, a high voltage pulse $V_{LP}$ is produced across the ballast 2 and causes the discharge lamp 3 to conduct.

In the above-described operation, if the anode current Icut, at which the silicon-controlled rectifier 5 is turned off, is in a range of a hundred to several hundred milliamperes, the ratio of Icut to the gate reverse current $I_G$off is 1 to 5 for an ordinary SCR. When a power supply of 100V is employed, therefore, a resistor of several KΩ used as the resistor 9.

After generation of the high voltage pulse $V_{LP}$, the silicon-controlled rectifier 5 is kept cut off and the source voltage $V_1$ is applied across the discharge lamp during the period from $t_4$ to $t_5$ to $t_6$. At time point $t_6$, the silicon-controlled rectifier 5 conducts again. This cycle of operation is repeated. This repetition of operation continues until the electrodes $f_1$ and $f_2$ of the discharge lamp 3 are heated sufficiently thereby to cause the discharge lamp to fire. The values of the resistors 6, 7 and 9 and the capacitor 8 are determined so that the silicon-controlled rectifier 5 is not turned on with the reduced voltage applied thereto from the voltage drop across the discharge lamp after it is lighted. In other words, after the lighting of the lamp, the discharge lamp repeats firing every half cycle, of the source voltage and thereby the voltage across the lamp also exhibits repeatedly a high peak value in pulse form. In order to prevent the silicon-controlled rectifier 5 from being turned on by this high peak voltage, the capacitor 8 and the resistor 6 are arranged to make up a high-frequency integrating circuit. By the way, the resistor 7 is for regulating the gate voltage and protecting the silicon-controlled rectifier 5.

The circuit of FIG. 2 which operates as explained above has superior discharge-lamp starting characteristics but sometimes poses the following practical problems: (1) The resistor 9 causes a power loss at the time of the lighting of the lamp; (2) There is only a small margin for stoppage of the starting operation after lighting of the lamp; and (3) An excessive reverse voltage is applied between the gate and cathode of the silicon-controlled rectifier 5.

Figure 4:
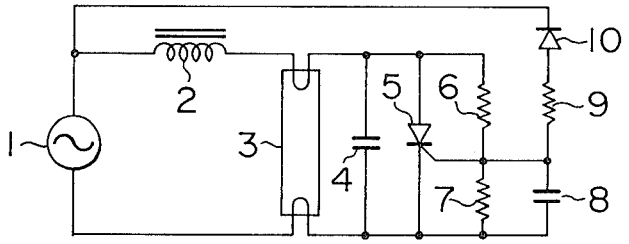
FIGS. 4 and 5 show the configurations of other embodiments of the invention.

A configuration of another embodiment of the invention which constitutes an improvement on the embodiment of FIG. 2 is shown in FIG. 4. Like or equivalent component elements are denoted by like numerals in FIG. 2. Reference numeral 10 shows a diode having one terminal thereof connected through the resistor 9 to the gate of the silicon-controlled rectifier 5 and the other terminal thereof connected to a junction point of the AC power supply 1 and the ballast 2.

The purpose for which the diode 10 is inserted is to prevent current from flowing through the resistor 9 to the gate of the silicon-controlled rectifier 5 when the source voltage on the side of the ballast 2 becomes positive. With this arrangement, the trigger signal, which is applied to the gate to turn on the silicon-controlled rectifier 5, is supplied only by the voltage across the discharge lamp and hence reduced to a smaller value after lighting. In other words, in the arrangement of FIG. 2, the stoppage of the starting operation of the silicon-controlled rectifier only relies on the reduced voltage across the discharge lamp after lighting of the same, while in this arrangement, since the insertion of the diode 10 is effective to reduce the trigger signal to a smaller value after lighting of the discharge lamp than before lighting, it assures a reliable stoppage of the starting operation of the silicon-controlled rectifier 5 after lighting of the discharge lamp than in the case of FIG. 1. Another advantage derived from the insertion of the diode 10 is to block the current in the resistor 9 in the half cycle, thereby reducing the power loss due to the resistor 9 to a half.

Figure 5:
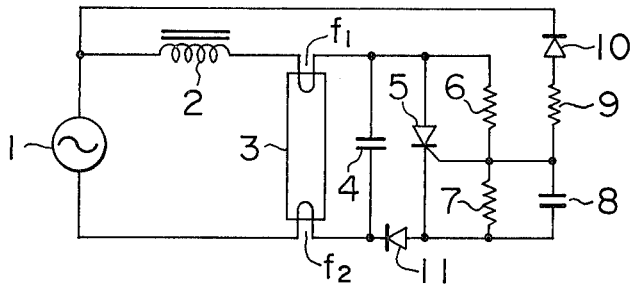

Still another embodiment of the invention employing a second diode has a configuration as shown in FIG. 5. In this drawing, like or equivalent component elements as in FIG. 4 are denoted by like reference numerals or characters as in FIG. 4. Reference numeral 11 shows the second diode added to the starter device of FIG. 4, which diode is inserted in the path between the cathode of the silicon-controlled rectifier 5 and the terminal of the filament $f_2$ on the side opposite to the power supply. The diode 11 eliminates the power loss which otherwise occurs due to the resistors 7 and 9. In other words, during the lighting the discharge lamp 3, when the voltage of power supply 1 is in the half-cycle where the cathode of the silicon-controlled rectifier 5 is positive in polarity, the power loss, which otherwise would occur due to current flow through the resistor 7, the capacitor 8, the resistor 9 and the diode 10, is prevented by the diode 11.

In the starter device shown in FIG. 5, the power loss which otherwise would be caused by the resistor 9 by lighting of the lamp is substantially elminated by the insertion of the diodes 10 and 11. Also, the power loss due to the resistor 6 is reduced. Further, the diode 11 prevents an excessive reverse voltage from being applied from the power supply 1 to the gate and cathode of the silicon-controlled rectifier 5 through the resistor 9 and the diode 10 during the cut-off state of the SCR.

The diode 11 has no adverse effect on the starting operation. In the first place, it will be understood the diode 11 is in no measure concerned with the turning on of the silicon-controlled rectifier 5 and the detection of turning on and off of the discharge lamp by the silicon-controlled rectifier 5. Secondly, in the period of time from $t_3$ to $t_4$ of FIG. 3, during which the silicon-controlled rectifier 5 is kept turned on and the diode 11 is conducting, the gate reverse current for turning off the silicon-controlled rectifier 5 is supplied from the power supply through the diode 11, the cathode and gate of the silicon-controlled rectifier 5, the resistor 9 and the diode 10. In this connection, application of a reverse bias voltage of several volts to between the cathode and the gate of the SCR is generally required to turn off the SCR. Since the gate reverse current continues until immediately before time $t_4$, a reverse bias voltage is applied between the cathode and the gate of the silicon-controlled rectifier 5 at time $t_4$, so that the silicon-controlled rectifier 5 is turned off or cut off and at the same time the diode 11 is cut off. The reverse bias voltage is stored also in the capacitor 8 thereby to maintain the reversely-biased state for a while. Therefore, the silicon-controlled rectifier 5 is not erroneously turned on by the high voltage pulse generated when the silicon-controlled rectifier 5 is cut off.

Generally, the resistor 6 may be set at a higher resistance value than that of the resistor 9. Even in the absence of the capacitor 8, therefore, the pulse voltage, even if several hundred volts, does not cause the gate potential of the silicon-controlled rectifier 5 to rise higher than the potential at the cathode thereof. Thus, the silicon-controlled rectifier 5 is not turned on erroneously by the high voltage pulse. In this way, the capacitor 8 is used to form a high frequency integrating circuit only for the purpose of absorbing the high-voltage pulse voltage generated across the discharge lamp 3 at the time of refiring thereof. The capacitor 8 is therefore not necessarily required in the case where the pulse voltage across the discharge lamp is not very high.

As a consequence, only the gate reverse current contributes to the power loss absorbed by the resistor 9 during the time points $t_3$ to $t_4$ as shown in FIG. 3 in the starting operation, thus greatly reducing the power loss as compared with that caused by the resistor 9 in the circuit of FIG. 1.

Referring again to the circuit of FIG. 5, in the case where it is sufficient to eliminate the power loss due to the resistor 9 by the diode 10, the diode 11 may be inserted between the silicon-controlled rectifier 5, the resistor 7 and that terminal of the capacitor 8 which is opposite to the gate of the silicon-controlled rectifier 5 for the sole purpose of protection of the silicon-controlled rectifier 5. The resistor 7, which is inserted for correcting the gate voltage and protecting the silicon-controlled rectifier 5, may be omitted if the characteristics of the SCR are satisfactory.

Figure 6:
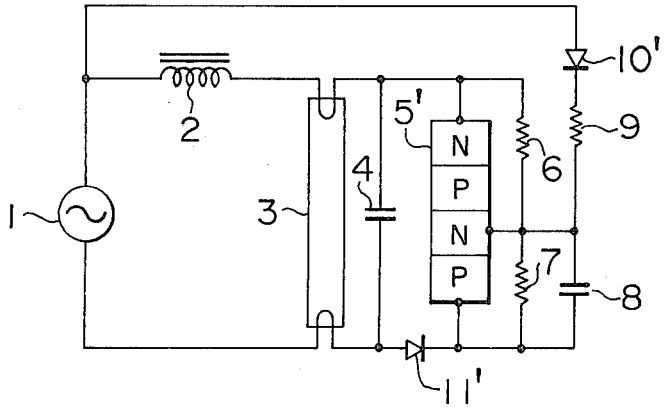
FIG. 6 is a diagram showing the configuration of still another embodiment of the invention.

A further embodiment of the invention is illustrated in FIG. 6. An N-gate type of thyristor 5′ is used in place of the silicon-controlled rectifier 5. Therefore, the diodes 10 and 11 are connected in opposite polarities to those of FIG. 5. The circuit of FIG. 6 functions substantially similarly to the circuit of FIG. 5.

According to the present invention in its embodiments described above, not only is the power consumption greatly reduced but also the starter is prevented from repeating its operation after lighting the lamp. Also, the invention may be used for the additional purpose of protection of a unidirectional thyristor with a control electrode, thus providing a starter for a discharge lamp which is simple in construction and reliable in operation.

According to other embodiments of the present invention, it is possible to prevent adverse effects due to variations in the characteristics of the SCR used as a switching element and to prevent the SCR from damage due to the high pulse voltage.

In the event that the cut-off characteristics of the SCR, namely, the current $I_G$off thereof is subject to a great variation, the magnitude of the pulse voltage generated also varies greatly. The pulse voltage is required to be set at a level between a voltage required to start the discharge lamp and the breakdown voltage of the SCR. Further, if the starting switch is turned off when the starter or the discharge lamp is in operation, the current that has so far flowed in the ballast is cut off, resulting in an excessively high pulse voltage which may damage the SCR element. Such a disadvantage is obviated by inserting a constant-voltage element or determining the place of insertion of the starting switch in such a manner as to prevent the voltage across the SCR from being excessively increased.

Figure 7:
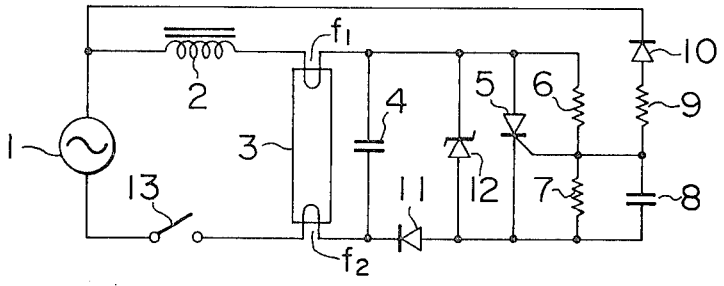
FIGS. 7 to 10 are diagrams showing further embodiments of the invention.

One of such embodiments of the present invention is shown in FIG. 7. A constant-voltage element 12 such as an avalanche diode or a varistor is connected in parallel with the silicon-controlled rectifier 5 between the anode and the cathode thereof in order to assure constant-voltage characteristics at the anode side. This circuit operates, in other aspects, in the same way as that of FIG. 5 for starting the discharge lamp.

The value of the constant voltage of the constant-voltage element 12 is set at a level between the voltage required for starting the discharge lamp and the breakdown voltage of the SCR. As a result, even in the case of a cut off under a large-current flow through the SCR which may occur due to the variation of the cut-off characteristics of the SCR during the operation of the starter, the pulse voltage generated in the ballast 2 is absorbed into a closed circuit consisting of the filaments $f_1$ and $f_2$ of the discharge lamp 3, the constant-voltage element 12, the diode 11 and the power supply 1, thereby preventing the voltage across the SCR from increasing beyond the constant voltage defined by the constant-voltage element 12.

Figure 8:
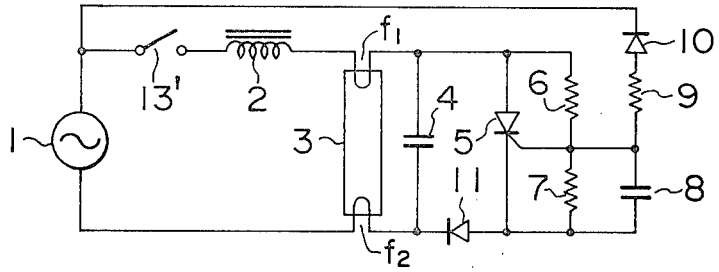

Still another embodiment of the present invention is shown in FIG. 8, where the starting switch 13′ is connected in series with the ballast 2. In this embodiment, the starting switch 13′ is inserted between the cathode of the diode 10 and the AC-power side terminal of the ballast 2. The high voltage pulse generated at the time of opening of the starting switch 13′ is applied across the starting switch 13′ but not across the silicon-controlled rectifier 5. Even when the switch 13′ is opened, therefore, the SCR does not breakdown.

In the embodiment of FIG. 7, the starting switch 13 may be inserted at any point in a current path between the terminal of the ballast 2 on the side opposite to the filament $f_1$ and the AC-power supply side terminal of the filament $f_2$. In the embodiment of FIG. 7, the starting switch 13 is inserted in the current path between the AC-power supply 1 and the filament $f_2$. The provision of the constant-voltage element 12 as shown in FIG. 7 has another advantage. This advantage is such that even when the starting switch 13 in the current path described in FIG. 7 is turned off at a large value of the current flowing in the ballast 2, a closed circuit is formed which consists of the ballast 2, the filament $f_1$, the constant-voltage element 12, the cathode and gate of the silicon-controlled rectifier 5, the resistor 9 and the diode 10. Therefore, the voltage applied across the silicon-controlled rectifier 5 does not increase beyond the constant voltage defined by the constant-voltage element 12. Moreover, the SCR element 5 is reversely biased, resulting in a lesser possibility of breakdown of the SCR element by the voltage from the viewpoint of dielectric strength characteristics.

It will be thus understood from the foregoing description that in the embodiments of FIGS. 7 and 8, the voltage across the SCR may be set at a level between the voltage required for starting the discharge lamp and the breakdown voltage of the SCR, thereby preventing the SCR from breakdown, even if the SCR is subjected to the on-off operation of the starting switch under large current or has a variation of cut-off characteristics.

Figure 9:
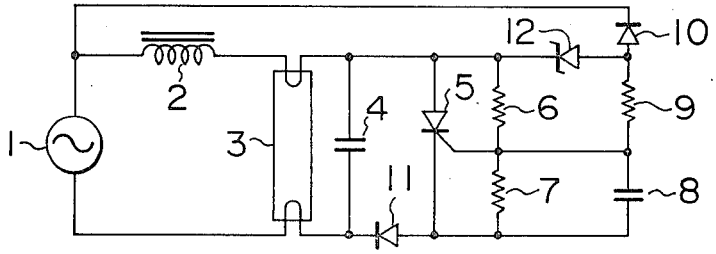

A still further embodiment of the invention is shown in FIG. 9. In this case, a constant-voltage element 12 is connected in parallel to the ballast 2 through the diode 10. This makes it possible to prevent the maximum value of one of the two types of pulse voltages generated in the ballast 2 from exceeding the constant-voltage value of the constant-voltage element 12. By setting the value of constant-voltage at a level not causing the breakdown of the silicon-controlled rectifier 5, a protecting circuit results.

Figure 10:
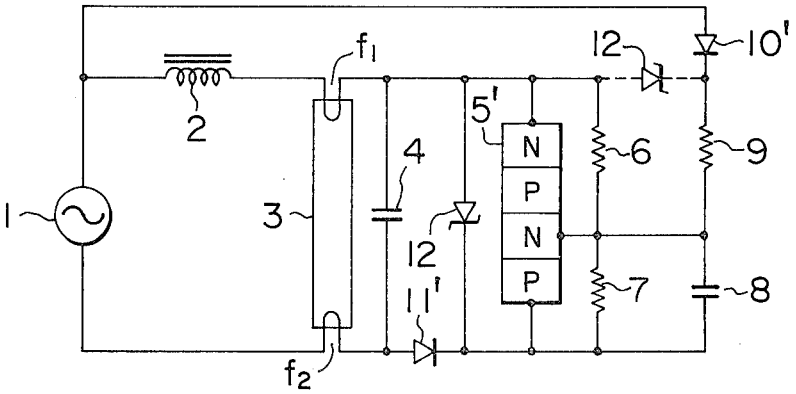

Referring to FIG. 10 showing a still further embodiment of the invention, an N-gate type thyristor 5′ is used in place of the silicon-controlled rectifier 5 in the preceding embodiments. Accordingly, the diodes 10 and 11 are connected in opposite polarities to the case of FIG. 7. As in the preceding embodiment, the thyristor 5′ is protected by the insertion of the constant-voltage element 12 at a similar position.

Incidentally, the dotted line in FIG. 10 shows that the constant-voltage element 12 is alternatively connected through the diode 10 to the ballast 2 as in the embodiment of FIG. 9.

We claim:

1. A starter for a discharge lamp having first and second filaments, said starter comprising a ballast transformer, a unidirectional thyristor having a control electrode and current-in and current-out electrodes, said current-in electrode being connected in series through said first filament and said ballast transformer to one terminal of an AC power supply, and said current-out electrode being connected through said second filament to the other terminal of said AC power source, a first resistor connected between said control electrode and said current-in electrode, and a second resistor connected between said control electrode and said one terminal of said AC power supply.

wherein a high voltage pulse is generated by said ballast transformer when said unidirectional thyristor is turned off.

2. A starter according to claim 1, further comprising a first diode connected in series with said second resistor, said first diode having a cathode connected to said one terminal of said AC power supply.

3. A starter according to claim 1, further comprising a diode connected in series with said current-out electrode of said thyristor, said second diode being connected in the same polarity as said thyristor.

4. A starter according to claim 1, further comprising a capacitor connected between said control electrode of said thyristor and said current-out electrode of said thyristor.

5. A starter according to claim 2, further comprising a second diode connected in series with said current-out electrode of said thyristor, said second diode being connected in the same polarity as said thyristor.

6. A starter according to claim 4, further comprising a third resistor connected in parallel to said capacitor.

7. A starter according to claim 5, further comprising a starting switch connected between said one terminal of said AC power supply and said ballast transformer.

8. A starter according to claim 5, further comprising a constant-voltage element connected in parallel to said thyristor to prevent the voltage applied to said thyristor from exceeding the breakdown voltage of said thyristor.

9. A starter according to claim 5, further comprising a constant-voltage element connected between a junction point of said second resistor and said first diode and a junction point of said current-in terminal of said thyristor and said first resistor, said constant-voltage element preventing the voltage applied to said thyristor from exceeding a predetermined breakdown voltage of said thyristor.

* * * * *